US006025686A

United States Patent [19]

Wickert et al.

[11] Patent Number: 6,025,686

[45] Date of Patent: Feb. 15, 2000

[54] METHOD AND SYSTEM FOR CONTROLLING MOVEMENT OF A DIGGING DIPPER

[75] Inventors: Francis G. Wickert, South Milwaukee; Shu-Chieh Chang, Greenfield, both of Wis.; Angela R. Halwas; David M. Lokhorst, both of Victoria, Canada; Bryan D. Roy, Cobble Hill, Canada

[73] Assignee: Harnischfeger Corporation, St. Francis, Wis.

[21] Appl. No.: 08/899,468

[22] Filed: Jul. 23, 1997

[51] Int. Cl.[7] ..... E02F 3/32

[52] U.S. Cl. ..... 318/568.18; 74/471 XY

[58] Field of Search ..... 318/568.11, 568.16, 318/568.17, 568.18, 568.2, 590; 74/471 XY; 180/324

[56] References Cited

U.S. PATENT DOCUMENTS

| | | | |
|---|---|---|---|
| 3,589,134 | 6/1971 | Hackmann et al. | 61/96 R |
| 3,630,389 | 12/1971 | Schmidt et al. | 214/1 CM |
| 3,637,092 | 1/1972 | George et al. | 214/1 CM |
| 4,113,123 | 9/1978 | Jeffrey | 214/141 |
| 4,377,043 | 3/1983 | Inui et al. | 37/18 R |
| 4,411,583 | 10/1983 | Petitto, Sr. et al. | 414/687 |
| 4,493,219 | 1/1985 | Sharp et al. | 73/862.05 |
| 4,598,380 | 7/1986 | Holmes et al. | 364/513 |
| 4,699,239 | 10/1987 | Ishino et al. | 180/315 |

(List continued on next page.)

FOREIGN PATENT DOCUMENTS

| | | |
|---|---|---|
| 1060562 | 8/1979 | Canada . |
| 1203309 | 4/1986 | Canada . |
| 0 293 057 A2 | 11/1988 | European Pat. Off. . |
| 0113157 | 9/1989 | Japan . |
| 2185593 | 7/1987 | United Kingdom . |

OTHER PUBLICATIONS

S. Deutsch & E. Heer. "Manipulator Systems Extend Man's Capabilities in Space". Astronautics & Aeronautics, Jun. 1972, pp. 30–40.

Michael Brady et al, "Robot Motion: Planning and Control", pp. 221–304, the MIT Press, 1983.

Technical Paper titled "End–Point Control of a Folding Arm crane", Sep. 1986, Fernsteuergerate, Kurt Olesch KG, Postfach 110409 110, Berlin, Germany.

Wallersteiner and Lawrence, "A Human Factors Evaluation of Teleoperator Hand Controllers", International Symposium on Teleoperation and Control, University of Bristol, England, Jul. 12–15, 1988.

John Craig, "Introduction to Robotics, Mechanics and Control", Second Edition, Addison–Wesley Publishing Co., New York 1989, pp. 253–256.

*Primary Examiner*—Bentsu Ro

*Attorney, Agent, or Firm*—Jansson, Shupe, Bridge & Munger, Ltd.

[57] ABSTRACT

A new method for controlling movement of a digging dipper includes providing an earthmoving machine with two drive systems for moving the dipper along two respective paths. Also provided is a control apparatus having a reference axis and a knob mounted for movement between a first, repose position and a maximum position spaced from the repose position by a maximum displacement dimension. The knob is displaced along a control axis to a second position which is spaced from the repose position by an actual displacement dimension less than the maximum displacement dimension. The drive systems are energized and the dipper is powered along a digging axis generally parallel to the control axis. A new apparatus for controlling movement of the dipper has a single control knob having a repose position and also has first and second motion transducers mechanically coupled to the knob. In a Cartesian coordinate system, the repose position is at the origin, the first transducer provides a first output signal when the knob is displaced along the "X" axis and the second transducer provides a second output signal when the knob is deflected from the repose position along the "Z" axis.

18 Claims, 10 Drawing Sheets

U.S. PATENT DOCUMENTS

| | | | |
|---|---|---|---|
| 4,800,660 | 1/1989 | Masao | 37/118 A |
| 4,835,710 | 5/1989 | Schnelle et al. | 364/513 |
| 4,864,746 | 9/1989 | Fukumoto | 37/103 |
| 4,910,673 | 3/1990 | Narisawa et al. | 364/424.07 |
| 5,062,264 | 11/1991 | Frenette et al. | 60/427 |
| 5,062,755 | 11/1991 | Lawrence et al. | 414/4 |
| 5,116,186 | 5/1992 | Hanamoto et al. | 414/694 |
| 5,160,239 | 11/1992 | Allen et al. | 414/699 |
| 5,167,121 | 12/1992 | Sepehri et al. | 60/422 |
| 5,170,342 | 12/1992 | Nakamura et al. | 364/167.01 |
| 5,178,510 | 1/1993 | Hanamoto et al. | 414/694 |
| 5,218,820 | 6/1993 | Sepehri et al. | 60/463 |
| 5,257,177 | 10/1993 | Bach et al. | 364/167.01 |
| 5,312,217 | 5/1994 | Lawrence et al. | 414/4 |
| 5,347,448 | 9/1994 | Nam | 364/167.01 |
| 5,383,390 | 1/1995 | Lukich | 91/361 |
| 5,404,661 | 4/1995 | Sahm et al. | 37/348 |
| 5,424,623 | 6/1995 | Allen et al. | 318/568.18 |
| 5,438,771 | 8/1995 | Sahm et al. | 37/348 |
| 5,446,981 | 9/1995 | Kamada et al. | 37/348 |
| 5,461,803 | 10/1995 | Rocke | 37/443 |
| 5,467,541 | 11/1995 | Greer et al. | 37/348 |
| 5,469,647 | 11/1995 | Profio | 37/398 |
| 5,490,081 | 2/1996 | Kuromoto et al. | 364/4.2 |
| 5,513,100 | 4/1996 | Parker et al. | 364/167.01 |
| 5,533,284 | 7/1996 | Esch | 37/348 |
| 5,572,809 | 11/1996 | Steenwyk et al. | 37/348 |
| 5,576,704 | 11/1996 | Baker | 341/20 |
| 5,598,090 | 1/1997 | Baker et al. | 322/3 |

FIG. 4
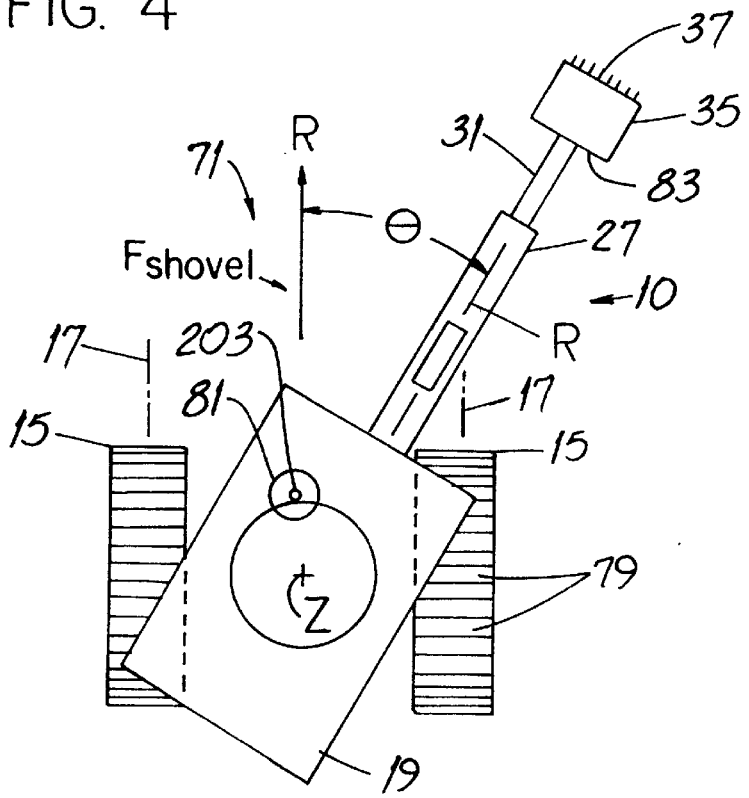
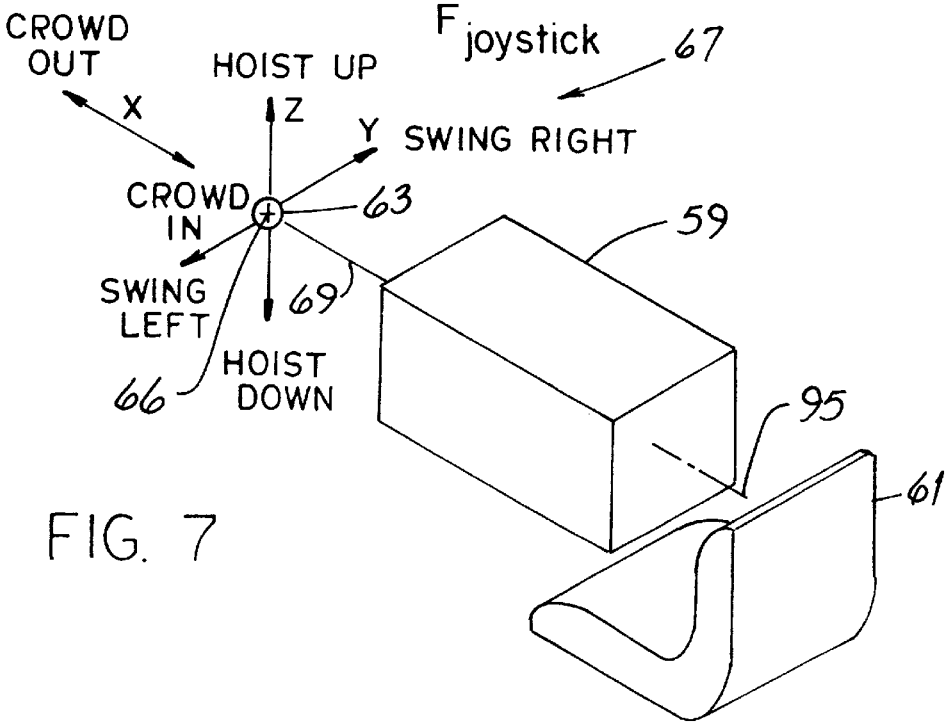
FIG. 7

METHOD AND SYSTEM FOR CONTROLLING MOVEMENT OF A DIGGING DIPPER

FIELD OF THE INVENTION

This invention relates generally to earth working and, more particularly, to the control of electrically-powered earth working machines and/or "hybrid" earth working machines having both electrically and hydraulically powered systems used to position a digging dipper.

BACKGROUND OF THE INVENTION

"Earth working" machines are made in a broad variety of machine type and drive system configurations. Two exemplary types of such machines in common use are mining shovels and draglines. Both are used in the process of extracting a valuable resource, e.g., coal, copper ore or the like, from the earth. Mining shovels, also referred to as excavators, and draglines can have a digging dipper or bucket capable of carrying anywhere from about 20 cubic yards (about 16 cubic meters) to about 120 cubic yards (about 100 cubic meters) or more of ore or the like. A leading manufacturer of mining shovels and draglines is Harnischfeger Corporation of Milwaukee, Wis.

A typical earth working machine, e.g., a mining shovel, has a platform supported on the ground by crawler tracks. A machinery "house" or upper portion is mounted on the platform and rotates about an axis of rotation which is vertical when the shovel is on level ground. The drive systems, whether electric, hydraulic or some combination thereof, used to power various functions of the shovel are mounted in the upper portion and one such drive system, often referred to as the "swing" function, causes the above-described rotation.

Extending from the machinery upper portion of a mining shovel is an upwardly, forwardly-pointing angled boom extending along a boom axis and supported by steel cables or lines. In normal operation, the boom angle does not change. A dipper stick or handle extends across and through the boom, is pivotable with respect to such boom and has a digging dipper (in the terminology of the industry) mounted at one handle end. The dipper has forward-pointing teeth which dig into and remove rock, ore or the like when the machine is being used.

An electrical rack-and-pinion type drive is capable of moving the handle (and, of course, the dipper attached to the handle) along an axis toward and away from the boom. This drive is often referred to as the "crowd" function since by using it, the operator can cause the dipper to crowd into a hillside, a pile of rock or the like.

The machine also has a winch for retrieving or paying out steel cable which extends over a rotatable pulley or sheave at the end of the boom and attaches to the dipper. Operation of the winch causes the handle to pivot about an axis on the boom and the winch drive is often referred to as the "hoist" function. Because the dipper can be moved by both the crowd and hoist drives, the dipper (and, notably, the dipper teeth) can be positioned anywhere within a two-dimensional "envelope" in a vertical plane coincident with the boom, the dipper handle and the axis of rotation of the machinery house. And when rotation of the upper portion is considered, the two-dimensional envelope becomes a three-dimensional "spatial" envelope.

A common way of using a mining shovel is to urge the dipper along the surface of the earth so that the dipper teeth are moving forwardly (i.e., away from the machinery house and the platform) and parallel to such surface. In the parlance of shovel manufacturers and users, this is referred to as "keeping grade."

A typical control arrangement has an operator's chair and two control levers, one each for manipulation by the operator's right and left hands, respectively. The right-hand control lever moves forward and backward to move the dipper using the hoist function and moves left and right to pivot the machinery house using the swing function. The left-hand control lever moves forward and backward to control the crowd function.

Commonly, such levers are at the ends of chair arm rests so that the operator need not support arm weight and so that the arms are steadied during lever manipulation. To keep grade or, for that matter, to move the dipper teeth along other paths (i.e., paths other than the single-function linear paths mentioned above), the operator must move the right-hand lever and the left-hand lever forward and backward in coordinated fashion.

Given the configuration of known control apparatus, keeping grade is very difficult. Proper coordinated lever movement to cause the dipper teeth to follow a desired path requires a good deal of skill and practice. The task is made more difficult because lever movement in view of the desired dipper movement is not at all intuitive. For example, the known control arrangement requires two levers to be moved forward and/or backward in some coordinated way, even though the desired path of the dipper teeth is along a horizontal line, i.e., neither forward nor backward.

Accurate dipper path control is certainly not a trivial consideration. A production objective is efficiency, i.e., to provide "three pass" loading of a large haulage truck. That is, the dipper and truck capacities are cooperatively selected so that three dippers full of material will fully load the truck. If the dipper is manipulated in a less-than-optimal way, the dipper will not completely fill on one or more passes and, perhaps, a fourth pass will be needed to completely fill the truck. Time is wasted and given the fact that the shovel and the truck each cost well over a million dollars (in fact, a large mining shovel costs several million dollars), the return on the investment is diminished.

And those are not the only problems attending use of known mining shovels. Another involves shoe and/or dipper damage.

As noted above, a mining shovel is mounted on a platform supported by crawler tracks. Each track is made up of a number of link-type shoes pivotably pinned to one another to form a continuous track. The swing function rotates the machinery house with respect to the tracks and since a mining shovel is several stories high, it is difficult for the operator, seated far above ground level, to always observe the position of the dipper with respect to the tracks and track shoes.

As a consequence, it is too common for an operator to strike a track shoe with the dipper. Shoe and/or dipper damage is likely to occur and damage repair translates to machine downtime and additional diminishment of the return on investment.

And mining shovels are not the only type of earth working machine where good control of the digging implement is highly desired but difficult to achieve. A dragline is also used for mining and, like a shovel, has a platform supported for rotation. Platform support is by what are known as "walk legs" having large, ground-contacting walking "shoes." A machinery house is mounted on the platform and rotates about an axis of rotation which is vertical when the dragline is on level ground. The electrical drive systems used to power various functions of the dragline, i.e., the swing, bucket hoist and bucket retrieval or dragging drives, are mounted in the machinery house. (While the digging implement of a mining shovel is referred to as a "dipper," the digging implement of a dragline is known as a "bucket.")

Extending from the machinery house is a long upwardly, forwardly-pointing angled boom supported by steel cables or lines and in normal operation, the boom angle does not change. The drag bucket is suspended from the boom by other lines and is oriented so that the bucket teeth face rearwardly, i.e., toward the machinery house. The bucket may be raised or lowered by operating the hoist drive. The dragline also has a winch with a rope-like steel cable attached to the bucket. When the winch is powered in a direction to retrieve cable, the bucket is dragged along the ground and drawn toward the machinery house.

In operation, the empty bucket is cast or "tossed" to a point away from the machinery house. Then the dragging winch and the hoist are operated in coordination to move the bucket along a particular contour using a combination of dragging and hoisting motion. For substantially the same reasons as described above, It is difficult for the operator to manipulate the control levers to achieve a particular grade contour.

And that is not the only control problem presented by a dragline. After the bucket is filled, it is hoisted while the machinery upper portion and boom are being swung to one side or the other. When the bucket is properly positioned directly above the "spoil pile" (which may be over 100 feet, about 30 meters, high), the bucket is emptied. While difficult, "spotting" the bucket directly over the pile is important to obtain the greatest pile volume per unit of land area occupied by the pile.

A new method and system for controlling movement of a digging dipper on a mining shovel or a bucket on a dragline and, optionally, for preventing or at least reducing dipper and track shoe damage in a mining shovel would be an important advance in the art.

OBJECTS OF THE INVENTION

It is an object of the invention to provide a new method and system for controlling movement of a digging dipper which address problems and shortcomings of the prior art.

Another object of the invention is to provide a new method for controlling movement of a digging dipper on a mining machine.

Another object of the invention is to provide a new method for controlling movement of a digging dipper which has utility for both mining shovels and draglines.

Yet another object of the invention is to provide a new method for controlling movement of the teeth of the digging dipper along or closely proximate to a desired path represented by command signals.

Another object of the invention is to provide a new method for controlling movement of a digging dipper by controlling dipper hoist and dipper crowd simultaneously and in a way which, for the human operator, is intuitive.

Still another object of the invention is to provide a new method which, optionally, controls dipper swing simultaneously with dipper hoist and crowd.

Another object of the invention is to provide a new control apparatus which causes movement of a dipper in a way that mimics movement of the apparatus knob.

Another object of the invention is to provide a new control apparatus having a single knob for controlling two, three or even four machine functions.

Yet another object of the invention is to provide a new method and system for controlling movement of a digging dipper which helps minimize damage to machine crawler shoes.

Another object of the invention is to provide a new method and system for controlling movement of a digging dipper which help improve machine efficiency.

How these and other objects are accomplished will become apparent from the following descriptions and from the drawings.

SUMMARY OF THE INVENTION

A method for controlling movement of a digging dipper includes providing an earthmoving machine having a digging dipper and first and second drive systems for moving the dipper along a first path ("crowd" only) and a second path ("hoist" only), respectively. A control apparatus is provided and has a reference axis and a knob mounted for movement between a first, repose position and a maximum position spaced from the repose position by a maximum displacement dimension.

The knob is displaced toward or away from the control apparatus housing along a control axis to a second position. In such second position, the control axis defines an angle with respect to the reference axis and the second position is spaced from the repose position by an actual displacement dimension which, at less than maximum digging speed, is less than the maximum displacement dimension. The drive systems are energized and the dipper is powered along a digging axis which is generally parallel to the control axis. The drive systems coact to power the dipper at a speed ranging from zero to a maximum dipper speed and the powering step includes powering the dipper at a digging speed generally proportional to the displacement of the knob from its repose position. That is, the actual digging speed, as a function of maximum digging speed, is generally equal to the maximum digging speed multiplied by the ratio of the actual displacement dimension to the maximum displacement dimension.

From the foregoing, it is apparent why the invention provides what is often referred to as "intuitive" control. Very briefly stated, the operator moves the knob in the direction s/he wants the dipper to move and moves such knob through a dimension which, when expressed as a percentage or fraction of the maximum possible dimension of knob movement, represents the speed (as a percent or fraction of the maximum speed) at which the dipper is desired to move.

In a more specific aspect of the method, the drive systems include first and second drive motors, respectively. The powering step includes generating first and second signals representing the angular velocities of the first and second drive motors, respectively.

Another aspect of the new method involves what might be termed "shoe protection." That is, the machine is controlled in such a way that the dipper is prevented from striking into a track and its shoes.

Where the machine has a platform supporting an upper portion which is rotatable about a rotation axis (mining shovels and draglines are such machines), a convenient control axis is coincident with a generally vertical plane which includes the rotation axis. And when the machine has a rotating upper portion, the displacing step includes or may include moving the knob laterally along a generally horizontal axis, thereby rotating the upper portion about the rotation axis.

And more specifically, when the platform is equipped with shoes forming a crawler track for transporting the machine (as with a mining shovel), the rotating step is followed by the step of stopping rotation of the upper portion when the dipper is at a predetermined distance from the shoes. The aforedescribed aspect of the method contemplates (and avoids) dipper/shoe impact as the machine upper portion is being rotated. But that is not the only circumstance during which the dipper might impact a shoe.

In another aspect of the method, it is assumed that the upper portion has been rotated so that the boom axis is angular to the machine axis, i.e., so that the dipper is to one side of the machine. The displacing step includes moving the knob toward the control apparatus housing, thereby commanding the dipper to move toward a track and its shoes. The method includes the step of stopping movement of the dipper as the dipper approaches one of the tracks.

Another aspect of the method is specific to the exemplary mining shovel used as a basis for describing the invention and relates to moving a specific part of the shovel dipper, i.e., the digging teeth, along a desired path. The second position of the knob is a command position representing the desired velocity ("velocity" is a vector representing both speed and direction). The knob-displacing step is followed by a computing step and the computing step includes determining, in a cylindrical coordinate system, "r" and "z" coordinates representing the commanded location of the points of the teeth. When shoe protection is provided, the computing step includes determining the "θ" coordinate, as well.

In a shovel-type mining machine, the first drive system drives what is referred to as a handle or "stick" which is connected to the dipper for dipper crowd. The second drive system drives a cable or line connected to the dipper for dipper hoist. The determining step includes computing commanded velocity signals for dipper crowd and dipper hoist. And such computing step is followed by the step of applying the velocity signals to first and second adjustable speed control panels (or "drives" as they are often referred to) which are connected to the first and second motors, respectively.

The aforementioned mining shovel has a hoist cable extending over a boom tip sheave and between the dipper and the first drive motor. The hoist cable has a length measured between two reference points, e.g., the tangent point of the cable and the sheave and a dipper connection point such as the dipper bail pin. And the dipper handle has a length measured (parallel to the dipper handle) between another two reference points, e.g., nominally the handle shipper shaft (about which the handle pivots) and the dipper bail pin. (Since the shipper shaft is nominally coincident with the handle rack line, mentioned in the following detailed description, but the bail pin is offset from such rack line, measuring "parallel to the dipper handle" means measuring between the shipper shaft and the bail pin, the latter "projected" to the rack line.) The powering step is followed by determining those two lengths.

A highly preferred way to determine such lengths is to use separate position sensors connected to the first and second drive motors, respectively. The signal from each of both position sensors is detected and such signals represent the lengths mentioned above. (Position sensors are available in both rotary and linear types. An example of the former is known as a "resolver." A linear position sensor would be used with hydraulic crowd and hoist drives which use hydraulic cylinders.)

A position sensor provides analog voltage output signals, each value of which represents a unique angular or linear position of the rotary or linear drive motor, respectively, to which it is connected. (An example of a linear motor is a hydraulic cylinder.) And a resolver includes gearing with a very large ratio so that the total rotation of the resolver is less than 3600 over the full excursion of dipper hoist or crowd, as the case may be.

Where the earthmoving machine is a dragline, the first drive system powers a dragging line extending between a drag winch and the dipper and the second drive system powers a hoist cable extending from the dragline boom to the dipper. The digging axis is angled with respect to a horizontal plane and generally defines a grade contour, i.e., a surface which slopes upwardly and rearwardly from a point of maximum "reach" of the dipper to a point very near the dragline.

Another aspect of the invention involves an apparatus for controlling movement of the dipper on an earthmoving machine. The apparatus has a single control knob having a repose position and first and second motion transducers mechanically coupled to the knob. (A transducer is a mechanism that converts a signal in one form, i.e., mechanical motion, to a signal in another form, i.e., a voltage representing such motion.)

In a coordinate system having an origin and "X," "Z" and "Y" axes perpendicular to one another (commonly known as a Cartesian coordinate system), the repose position of the control apparatus (and, especially, of the knob) is at the origin. The first motion transducer provides a first output signal when the knob is displaced from the repose position along the "X" axis and the second motion transducer provides a second output signal when the knob is deflected from the repose position along the "Z" axis.

In a slightly different embodiment, the apparatus has a third motion transducer mechanically coupled to the knob for providing a third output signal when the knob is deflected from the repose position along the "Y" axis. And a control apparatus having even four motion transducers (thereby enabling a machine "tilt" function as in a large electro-hydraulic machine) may be configured.

Other aspects of the invention are set forth in the following detailed description and in the drawings. The detailed description discusses Inverse Kinematics and Forward Kinematics, both used in the field of robotics. Textbooks in the field include *Introduction to Robotics: Mechanics and Control*, by John J. Craig (IBSN 0-201-09528-9), and *Robot Motion: Planning and Control*, edited by Michael Brady (IBSN 0-262-02182-X), both of which are incorporated herein by reference.

BRIEF DESCRIPTION OF THE DRAWINGS

FIG. 4 is a representative top plan view of the shovel of FIG. 1 shown with the machinery upper portion, boom and shovel handle swung somewhat clockwise from a forward-facing reference position R'.

FIG. 7 is a perspective view of the control apparatus and seat shown in FIG. 6. "X," "Y" and "Z" are in capital letters.

DETAILED DESCRIPTIONS OF PREFERRED EMBODIMENTS

Overview

Figure 1:
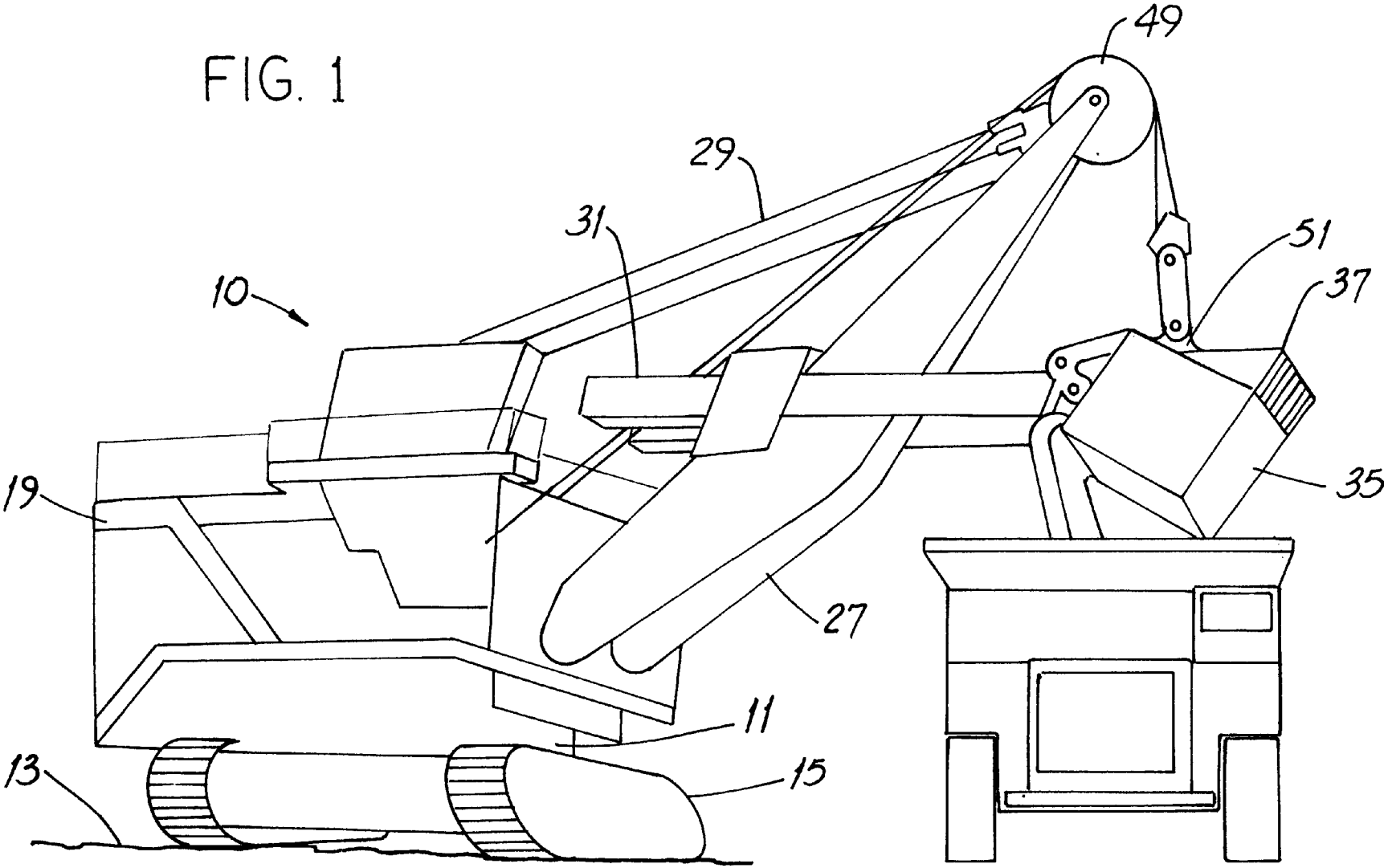
FIG. 1 is a representative perspective view of a mining shovel shown in conjunction with a haulage truck.

In this description and in the drawings, capital or upper case letters denote axes and fixed (i.e., constant) dimensions. Small or lower case letters denote variables.

The following description uses an electrically-powered mining shovel as an example of a type of earthmoving machine with which the invention is used. However, it is to be understood (and those of ordinary skill will appreciate) that the invention is equally adaptable to hydraulic or hybrid machines.

The disclosed system uses what is known as closed loop or "feedback" control. Briefly described, feedback control involves generating a command signal which "tells" the system the path that the operator wants the dipper teeth to follow. Rotation of an electric motor, e.g., the hoist motor, is then "sensed" or "resolved" to provide a feedback signal "telling" the system the path the dipper teeth actually followed. The command and feedback signals are then compared and the "error" is used to automatically make incremental corrections. As further described below, moving the knob of the control apparatus provides the command signals.

The invention involves a dipper-equipped earthworking machine and a method and apparatus used to move the dipper teeth along a path as commanded by the operator who manipulates a joystick-type control apparatus. And dipper teeth are capable of being moved within what might be called a three-dimensional spatial envelope.

Therefore, aspects of the method and apparatus are described in geometric terms and with respect to a geometric coordinate system. Such description is used because the field of geometry offers a way (perhaps the only practical way) to establish the actual and desired positions of dipper digging teeth within the envelope. And the mathematical equations which relate to the invention are couched in such geometric terms.

Understanding of the specification will be aided by the following brief explanation of some aspects of a mining shovel 10. Referring first to FIGS. 1, 2, 3, 4, 5A, 5B and 13, the shovel 10 has a platform 11 supported on the ground 13 by crawler tracks 15 which extend along axes 17 generally parallel to the machine axis R. A machinery upper portion 19 is mounted on the platform 11 and rotates about an axis of rotation Z which is vertical when the shovel 10 is on level ground 13. The electrical drive systems 21, 23, 25 used to power various functions of the shovel 10 are mounted in the upper portion 19 and one such drive system, often referred to as the "swing" drive system 25, causes the above-described rotation. (Each drive system 21, 23, 25 comprises an electrical control panel, sometimes known as a "drive," and an electric motor controlled by such panel.)

Extending from the machinery upper portion 19 is an upwardly, forwardly-pointing angled boom 27 extending along a boom axis W and supported at its outer end by steel cables 29. In normal operation, the boom angle does not change.

A dipper "stick" or handle 31 extends across and through the boom 27, and pivots with respect to the boom 27. The handle pivots about a shaft 33 known as a shipper shaft. The digging dipper 35 is mounted at one handle end and has forward-pointing teeth 37 which dig into and remove rock, ore or the like when the shovel 10 is being used.

An electric motor 39 coupled to rack-and-pinion type gearing is capable of moving the handle 31 (and, of course, the dipper 35 attached to the handle 31) along a path toward and away from the boom 27. Such path is generally linear but not perfectly so. The drive system 23 is often referred to as the "crowd" drive system since by using it, the operator can cause the dipper 35 to crowd into a hillside, a pile of rock or the like.

The shovel 10 also has an electric motor 43 powering a winch 45 for retrieving or paying out steel cable 47 which extends over a rotatable sheave 49 at the end of the boom 27 and attaches to the dipper 35 at the dipper bail 51 and bail pin 53. Operation of the winch 45 causes the dipper handle 31 to pivot about the axis 55 of the shipper shaft 33. The drive system 21 is often referred to as the "hoist" drive system since the operator can actuate it to cause the dipper 35 to hoist and lower.

From the foregoing, it will be appreciated that if the crowd drive system 23 is maintained de-energized and only the hoist drive system 21 is used, the handle 31 and dipper 35 pivot and the dipper teeth 37 define an arc of a circle, the center of which is substantially coincident with the shipper shaft 33. Because the dipper 35 can be moved by both the crowd and hoist drive systems 23, 21, respectively, the dipper 35 (and, notably, the dipper teeth 37) can be positioned by such drive systems 23, 21 anywhere within a two-dimensional envelope in a vertical plane defined by axes W and V, also referred to as $F_{boom}$, a Cartesian coordinate system shown in FIG. 3 and further explained below.

Figure 2:
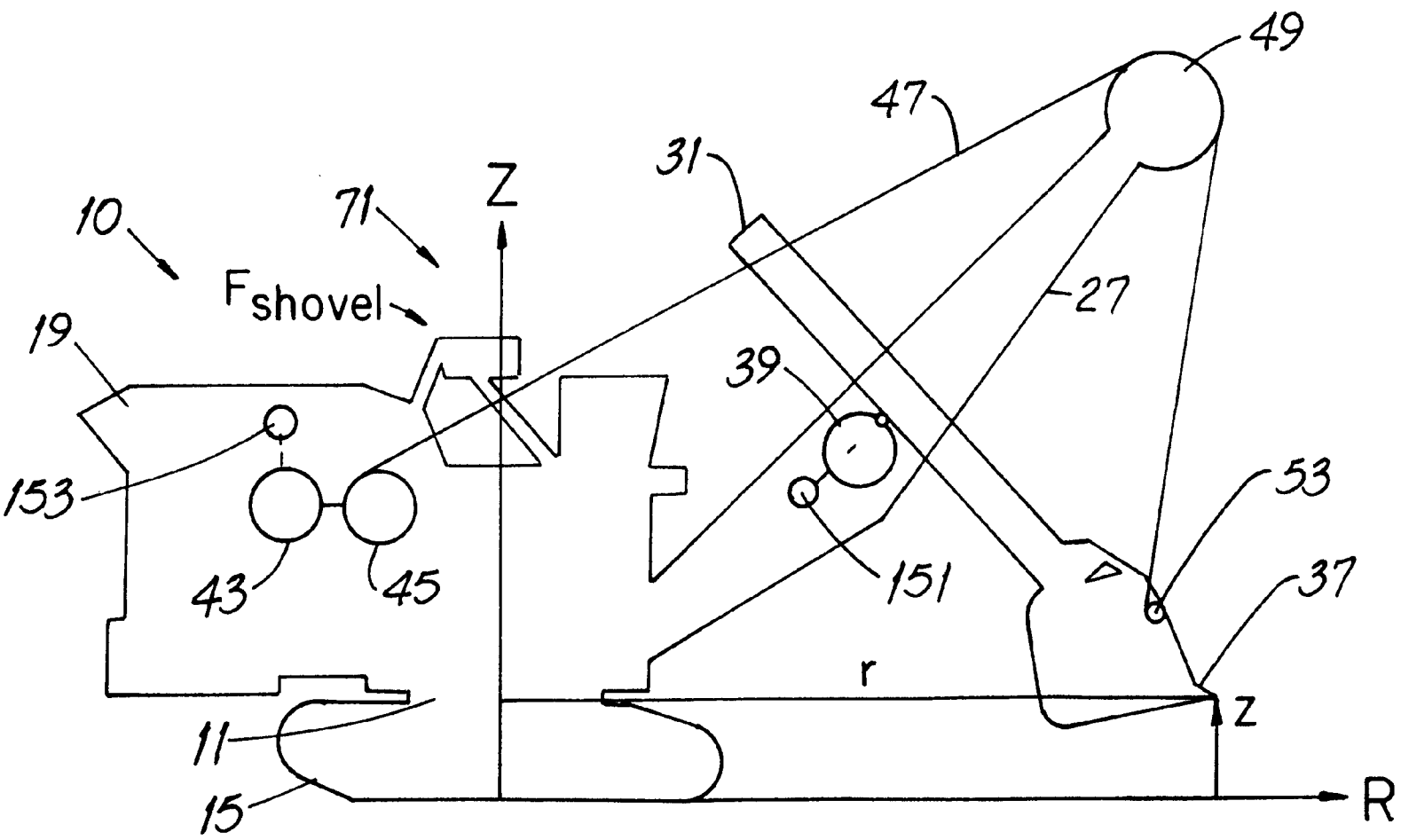
FIG. 2 is a representative side elevation view of the mining shovel of FIG. 1.
Figure 3:
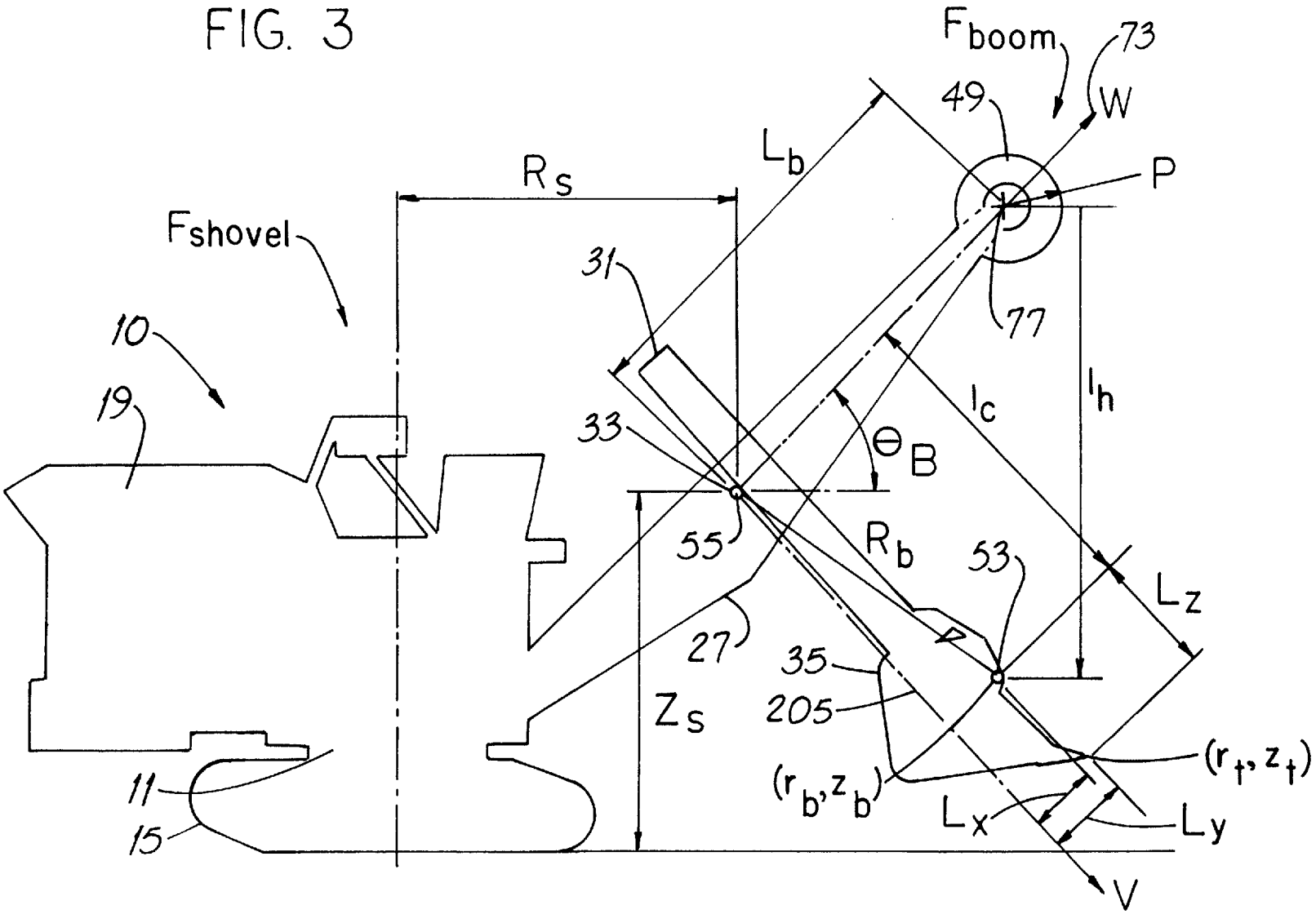
FIG. 3 is another representative side elevation view of the mining shovel of FIG. 1.

A common way of using a mining shovel 10 is to urge the dipper 35 along the ground 13 so that the dipper teeth 37 are moving forwardly (i.e., away from the the platform 11) and parallel to the ground 13. For reasons relating to the following description in geometric terms, FIGS. 2 and 3 show the dipper 35 and its teeth 37 spaced somewhat above the ground 13. However, common practice is to move the dipper 35 with the teeth 37 closely proximate the ground 13. And the ground 13 need not be (and often is not) level. As will be appreciated, the method and control apparatus 59 (shown in FIGS. 6, 7, 8, 11 and 12) enable movement of the teeth 37 along a sloped surface (to keep grade) in a way that is commanded by the operator using the joystick control apparatus 59.

The hoist and crowd drive systems 21, 23, respectively, are those primarily used during actual digging. To put it another way, digging usually involves moving the dipper teeth 37 toward or away from the platform 11 and upwardly or downwardly with respect to the ground 13.

Figure 6:
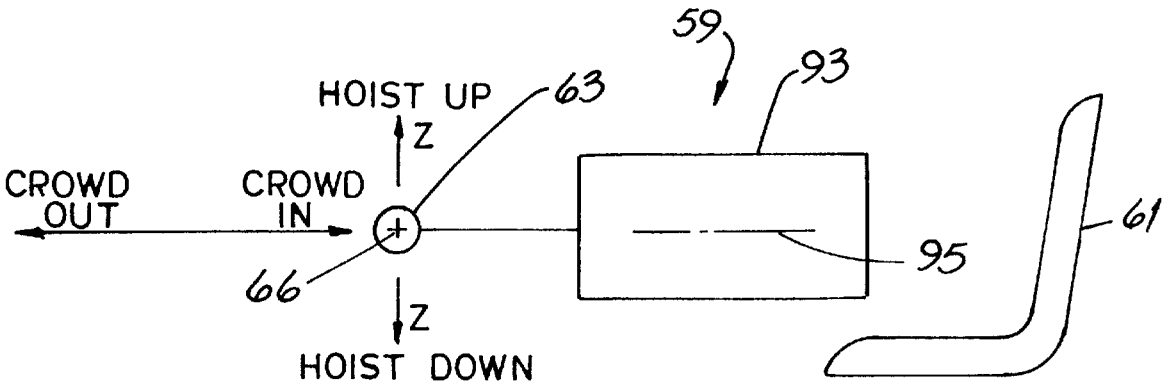
FIG. 6 is a representative side elevation view of the control apparatus shown in conjunction with an operator's seat. "X" and "Z" are in capital letters.
Figure 8:
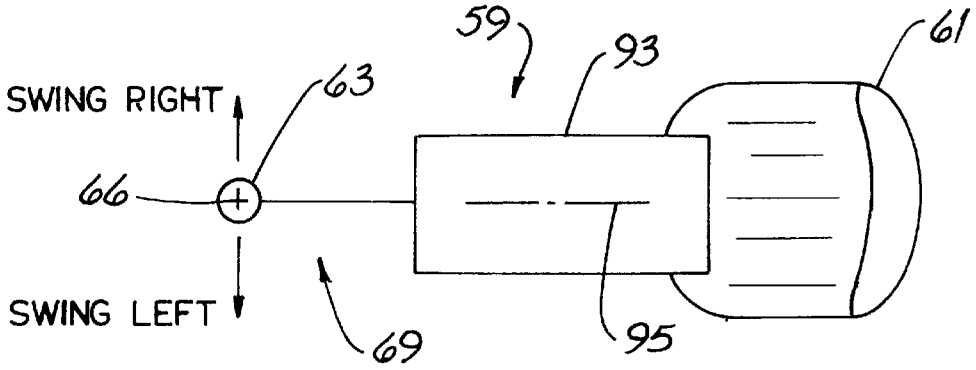
FIG. 8 is a representative top plan view of the control apparatus and seat shown in FIG. 6. "Y" is in capital letters.

Description of Control Apparatus and Mining Shovel in Geometric Terms—Hoist and Crowd Aspects of the control apparatus 59 are first described in geometric terms. FIGS. 6, 7 and 8 show such apparatus 59 in conjunction with a operator's seat 61. The seat 61 is shown to aid "visualization" of how, from the perspective of the operator, the apparatus knob 63 can be moved and how the dipper 35 and dipper teeth 37 move correspondingly.

The apparatus 59 has a joystick knob 63, the center 65 of which is coincident with the origin 66 of the illustrated Cartesian coordinate system 67 for the joystick 69 when such stick 69 is in the neutral position undeflected in any direction. Referring particularly to FIGS. 6 and 7, the knob 63 can be moved upwardly or downwardly in the "Z" direction for energizing the hoist function to retrieve or pay out cable 47, respectively. Such knob motion causes the dipper handle 31 to pivot (in the views of FIGS. 2 and 3) counterclockwise or clockwise, respectively. The knob 63 can also be pulled outwardly or pushed inwardly in the "X" direction for energizing the crowd function to extend or withdraw, respectively, the dipper handle 31.

Relative to an operator, the following directions of joystick deflection are defined:

"X" direction - positive forward, negative backward,

"Y" direction - positive to left, negative to right,

"Z" direction - positive upward, negative downward.

The Cartesian coordinate system 67, also denoted as $F_{joystick}$, is fixed with respect to the machine upper portion 19 and does not move with respect to such upper portion 19 when the joystick 69 is deflected. This definition has the following implications:

$F_{joystick}$ remains in constant orientation relative to the upper portion 19 and, of course, to the operator. $F_{joystick}$ rotates with and when the upper portion 19 rotates.

Having so defined $F_{joystick}$, the vector $j=[j_X\, j_Y\, j_Z]$ is defined to be the deflection of the center 65 of the knob 63 measured from the origin to the center 65 of such knob 63. That is, $j_X$ is the "X" component of the deflection of the joystick 69, $j_Y$ is the "Y" component of the deflection of the joystick 69 and $j_Z$ is the "Z" component of the deflection of the joystick 69.

Next, a cylindrical coordinate system 71 (synonymously known as a polar coordinate system), also denoted as $F_{shovel}$, in the machine/shovel frame of reference is described. Referring next to FIGS. 2 and 4, the variable angle θ measures the angular displacement of the upper portion 19, boom 27 and dipper handle 31 from the axis R' (which is fixed with respect to the platform 11 and is always parallel to track axes 17) to the axis R. That is, the "R" axis of $F_{shovel}$ swings with the upper portion 19 and is always aligned with the boom 27.

The position of the dipper teeth 37 in terms of $F_{shovel}$ are given by the coordinates [r θ z] where:

r is the radial distance to the dipper teeth 37,

θ is the angular displacement to the dipper teeth 37, i.e., the swing angle θ, and z is the vertical distance to the dipper teeth 37 from the ground 13 shown in FIG. 1.

Referring next to FIGS. 2, 3, 4 and 7, while the two frames of reference, $F_{joystick}$ and $F_{shovel}$ described above, are useful in understanding the new method and apparatus 59, it is convenient to define a third coordinate system 73, a Cartesian coordinate system 73 also denoted as $F_{boom}$, which refers certain angles and dimension to the shovel boom 27 rather than to the shovel itself. The system $F_{boom}$ is fixed with respect to the boom 27 and has its origin at the center axis 55 of the shipper shaft 33. The system $F_{boom}$ swings as the upper portion 19 and boom 27 swing. Stated another way, the boom 27 is always coincident with and moves in the vertical "VW" plane of $F_{boom}$.

The "W" axis of $F_{boom}$ passes through the origin, axis 55, and through the axis of rotation 77 of the boom sheave 49. The angle $\theta_B$ is called the boom angle and the distances $R_s$ and $Z_s$ denote a radial distance (measured horizontally) and a vertical distance, respectively, as measured from the origin 77.

The transformations of coordinates between $F_{boom}$ and $F_{shovel}$ are given in the following equations:

$$\begin{bmatrix} r \\ z \end{bmatrix} = \begin{bmatrix} \sin\theta_B & \cos\theta_B \\ -\cos\theta_B & \sin\theta_B \end{bmatrix} \begin{bmatrix} v \\ w \end{bmatrix} + \begin{bmatrix} R_s \\ Z_s \end{bmatrix} \quad (1.1)\ (1.2)$$

or $$\begin{bmatrix} v \\ w \end{bmatrix} = \begin{bmatrix} \sin\theta_B & -\cos\theta_B \\ \cos\theta_B & \sin\theta_B \end{bmatrix} \begin{bmatrix} r - R_s \\ z - Z_s \end{bmatrix} \quad (1.3)\ (1.4)$$

Description of Control Apparatus and Mining Shovel in Geometric Terms - Swing Configuring the shovel 10 to implement the new method for hoist and crowd yields substantial productivity benefits. However, yet additional advantages accrue if the shovel 10 is also configured to protect the tracks 15 and shoes 79.

Referring next to FIGS. 4, 7, 8 and 13, in a highly preferred embodiment, the control apparatus 59 is configured so that its joystick knob 63 may also be moved left and right in the "Y" direction. Movement of the knob 63 in the "Y" direction operates the swing drive system 25.

And the dipper 35 is capable of being moved other than only in the vertical plane "VW" as described above. When the swing function is used, the machine upper portion 19 (and the boom 27 and dipper handle 31 supported thereby) are driven by the swing motor 81 to rotate about the vertical axis Z. When the boom 27 and dipper handle 31 are in registry with the axis R', this position is arbitrarily defined as 0° rotation. And the angle of rotation away from such axis R', i.e., between the axis R' and R, is identified as θ.

Figure 9:
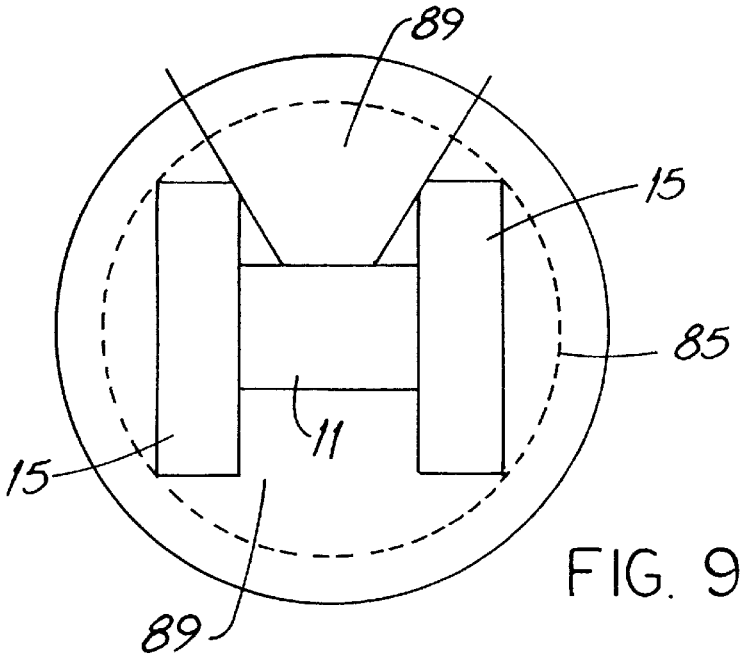
FIG. 9 is a simplified top plan view of the lower portion of the shovel of FIG. 1.
Figure 10:
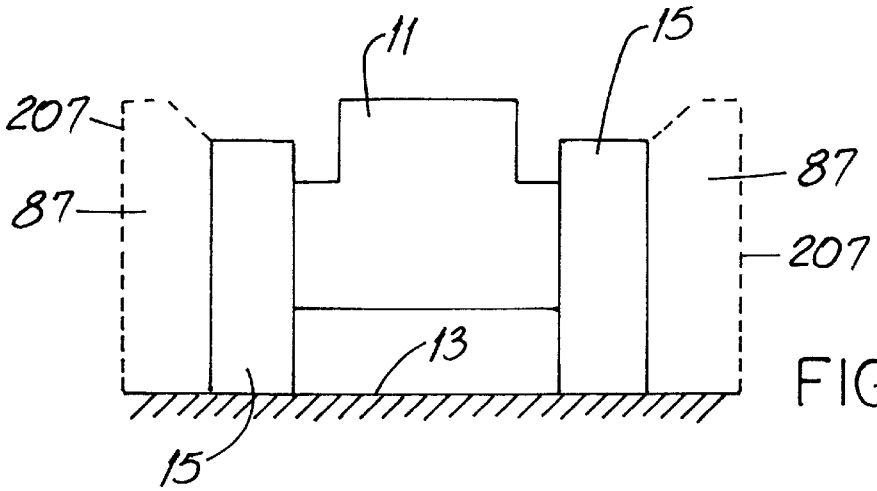
FIG. 10 is a simplified elevation view of the lower portion of the shovel of FIG. 1.

Considering FIGS. 4, 9 and 10, it is apparent that if the dipper 35 (including its rear edge 83) is outside the circle 85, the upper portion 19 and dipper 35 are free to move (consistent with machine mechanical constraints) to any position around the shovel 10 or above the ground 13. However, considering FIGS. 4 and 10, if the boom 27 is nominally at a right angle to the axis R' and if the dipper 35 is being moved toward one of the tracks 15, steps should be taken to stop dipper 35 movement before the dipper 35 enters one of the spatial "danger zones" 87 adjacent to the tracks 15. (The sizes and locations of the zones 87 denote that if any part of a dipper 35 is in one of the zones 87, such dipper 35 is assumed to be dangerously close to striking a track 15 and its shoes 79.) And considering FIG. 9, the dipper 35 can be "tucked" or moved into the region 89 between the tracks 15 so long as steps are taken to prevent significant rotation while the dipper 35 is so positioned.

Considering the foregoing in another way, some aspects of the invention, i.e., those primarily relating directly to machine productivity and moving the dipper 35 away from the platform 11 in a digging direction, involve identifying and controlling the location of the dipper digging teeth 37. Other aspects of the invention, identified in the vernacular as shoe protection, primarily relate to downtime and damage avoidance which might otherwise result when moving the dipper 35 "backwards," i.e., toward the platform 11 or otherwise (e.g., by rotating the upper portion 19) in a manner to run the risk of striking a shoe 79 with the dipper 35. The latter aspects involve the sides and rearmost parts of the dipper 35 and controlling dipper movement so that such sides and rearmost part do not strike a shoe 79.

Description of Electrical/Mechanical Aspects of Control Apparatus

Referring next to FIGS. 6, 7, 8, 11 and 12, the control apparatus 59 has a housing 93 extending along a reference axis 95. A single control knob 63 is mounted on a rod 97 which protrudes from such housing 93. The apparatus 59 has a detent spring 99 which lightly retains the knob 63 in its repose position shown, for example, in FIGS. 6, 7, 8 and 12 (i.e., with the knob center 65 at the origin 66 of $F_{joystick}$).

As also described above, the knob 63 is capable of being moved along an "X" axis (left/right as viewed in FIGS. 6 and 12 and out/in to an occupant of the seat 61) for controlling the crowd drive system 23 and along a "Z" axis (up/down as viewed in FIGS. 6, 7 and 12 and also to an occupant of the seat 61) for controlling the hoist drive system 21. And in a highly preferred embodiment, the knob 63 is capable of being moved along a "Y" axis for controlling the swing drive system 25. The "directionality" of the "Y" axis is right/left to an occupant of the seat 61, is represented by the symbol 101 denoting an arrow away from the viewer and by the symbol 103 denoting an arrow toward the viewer of FIG. 12.

Figure 12:
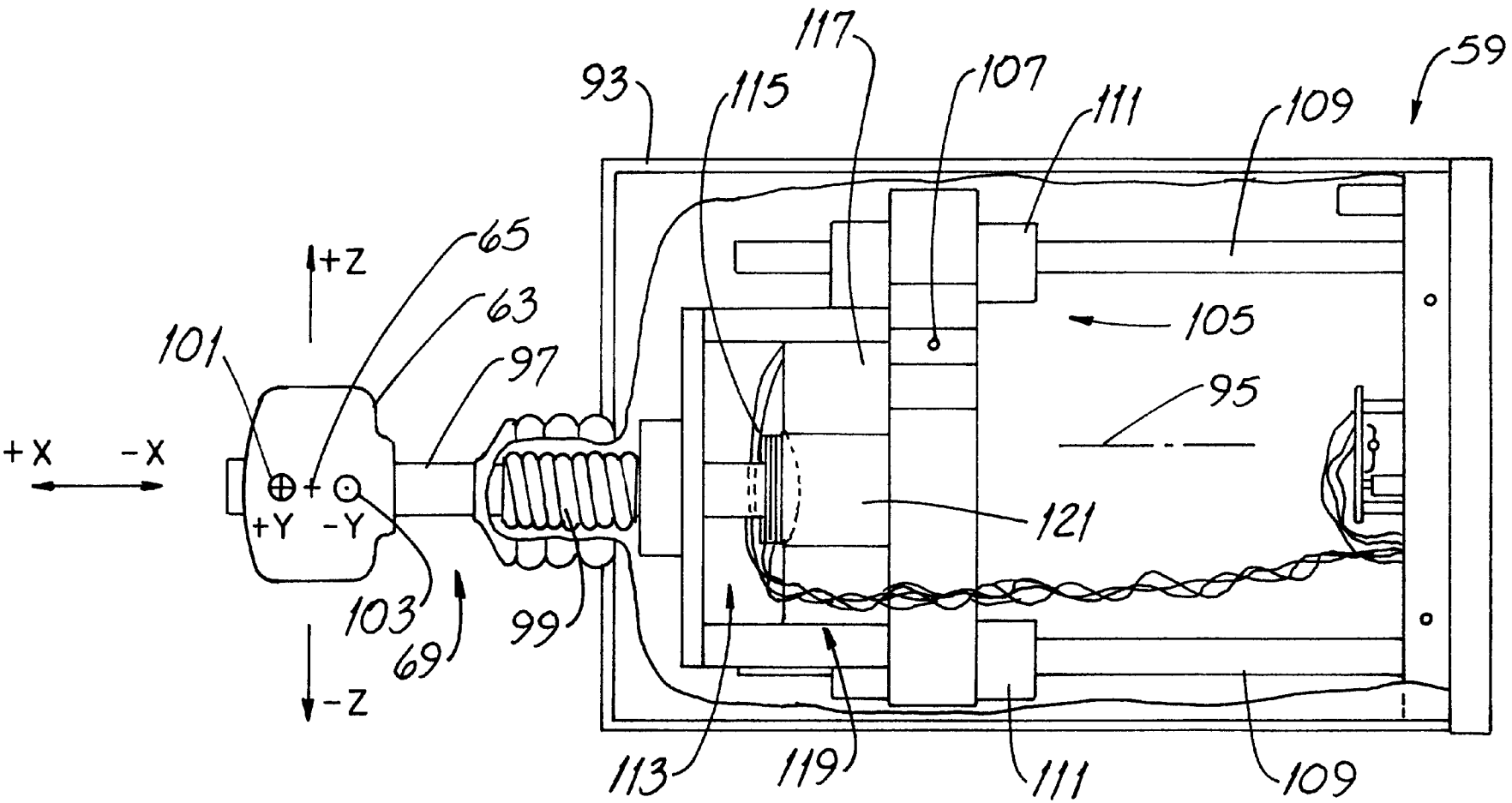
FIG. 12 is a side elevation view, partly in section, of the control apparatus taken from the same viewing point as that of the apparatus of FIG. 6.

The apparatus 59 has a first motion transducer 105 comprising a magnetic pickup device 107 supported by magnetic guide bars 109 for movement (left and right in FIG. 12) along the reference axis 95. The device 107 moves with respect to a bar-supported magnet 111, the position of which is fixed on a bar 109. The device 107 moves when the knob 63 is moved along the "X" axis which, in FIG. 12, is coincident with the reference axis 95. The first transducer 105 controls the crowd drive system 23 by providing a first output signal, e.g., a first output voltage, the magnitude of which is a function of the dimension by which the pickup 107 and the knob 63 are displaced from the origin 66 along the "X" axis.

The apparatus 59 also has a second motion transducer 113 comprising an induction pickup assembly 115 which moves, with respect to what is referred to as a second head 117. Movement is in up/down directions as shown in FIG. 12 when the knob 63 is moved along the "Z" axis. The transducer 113 controls the hoist/lower drive system 21 by providing a second output signal, e.g., a second output voltage, the magnitude of which is a function of the dimension by which the knob 63 is displaced along the "Z" axis from the origin 66.

Most preferably, the apparatus 59 also has a third motion transducer 119 comprising the assembly 115 which moves, with respect to a third head 121, in directions into and out of the drawing sheet of FIG. 12 when the knob 63 is moved along the "Y" axis. The third transducer 119 controls the swing drive system 25 by providing a third output signal, e.g., a third output voltage, the magnitude of which is a function of the dimension by which the pickup 107 and the knob 63 are displaced from the origin 66 along the "Y" axis.

An example of the way the new control apparatus 59 is used to control the movement of the dipper teeth 37 in the "VW" plane is as follows. Considering FIGS. 6, 7, 8, 12 and particularly FIG. 11, it is assumed that the dashed outline 125 denotes the repose position of the knob 63 at the origin 66, the dashed outline 127 denotes the maximum displaced position of the knob 63 in the dipper lowering direction, i.e., along the "−Z" axis, and the dashed outline 129 denotes the maximum displaced position of the knob 63 in the dipper crowding direction, i.e., along the "+X" axis.

It is also assumed that the shovel operator displaces the knob 63 from the first or repose position 125 by urging such knob 63 away from the housing 93 and by also depressing the knob 63. It is further assumed that the final or second position of the knob 63, as selected by the operator, is at the location 131 and the joystick 69 is along a control axis 133. Such urging and depressing can occur in either sequence. However, for reasons relating to intuitive control as described below, such urging and depressing are preferably carried out simultaneously and the shovel operator will quickly learn to do so and will prefer to do so.

Figure 11:
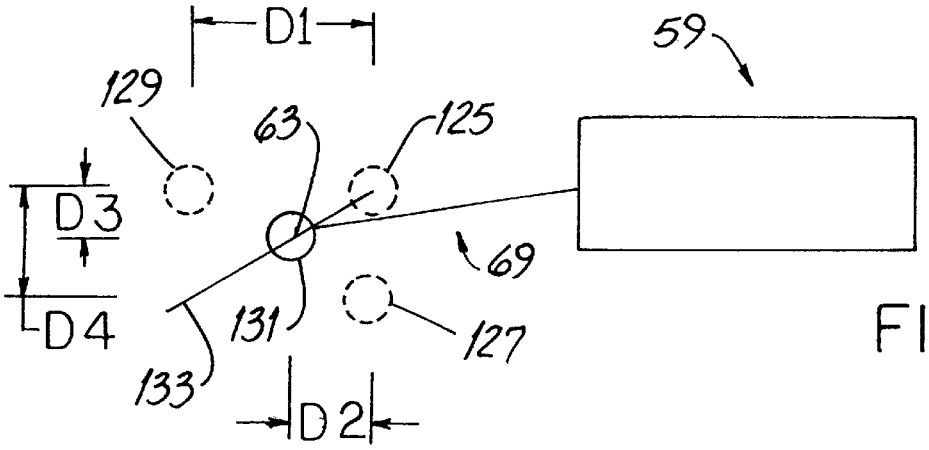
FIG. 11 is a side elevation view of the control apparatus of FIGS. 6, 7 and 8 showing, in solid and dashed outline, the apparatus joystick knob at various locations.

It is to be noted that, considered with respect to the "X" axis, such final position 131 is spaced from the repose position by a second dimension D2 which is less than the first dimension D1 and is about half-way between the repose position 125 and the position 129. It is also to be noted that, considered with respect to the "−Z" axis, such final position is at a distance D3 which is about half of the distance D4 between the repose position 125 and the position 127. With the knob 63 at the location 131, the dipper teeth 37 will move downwardly and outwardly along a path that is generally parallel to the axis 133 as shown in FIG. 11.

And such movement will be at about 50% of the rated lowering speed and 50% of the rated crowding speed, respectively. Considering the crowding direction alone, movement of the teeth 37 will be at a speed generally equal to the maximum speed in the crowd direction multiplied by the ratio of the second dimension D2 to the first dimension D1 i.e., by a ratio of about 0.5.

Certain aspects of the invention are now apparent. One is that the knob position defines a velocity, i.e., a vector having both magnitude, representing speed, and direction which represents direction of tooth travel. (It is important to appreciate that while the term "velocity" is sometimes used—incorrectly—to denote only speed, such term is a vector term.) Another now-apparent aspect of the invention is that the method is "intuitive" (and the apparatus 59 provides what might be termed "intuitive control") because the dipper teeth 37 move, in both speed and direction, and "follow" movement of the knob 63. That is (after a modest degree of familiarization), the operator intuitively knows how to manipulate the apparatus knob 63 to move the dipper teeth 37 along a desired path.

Description of Control Diagram for Hoist and Crowd

Figure 5A:
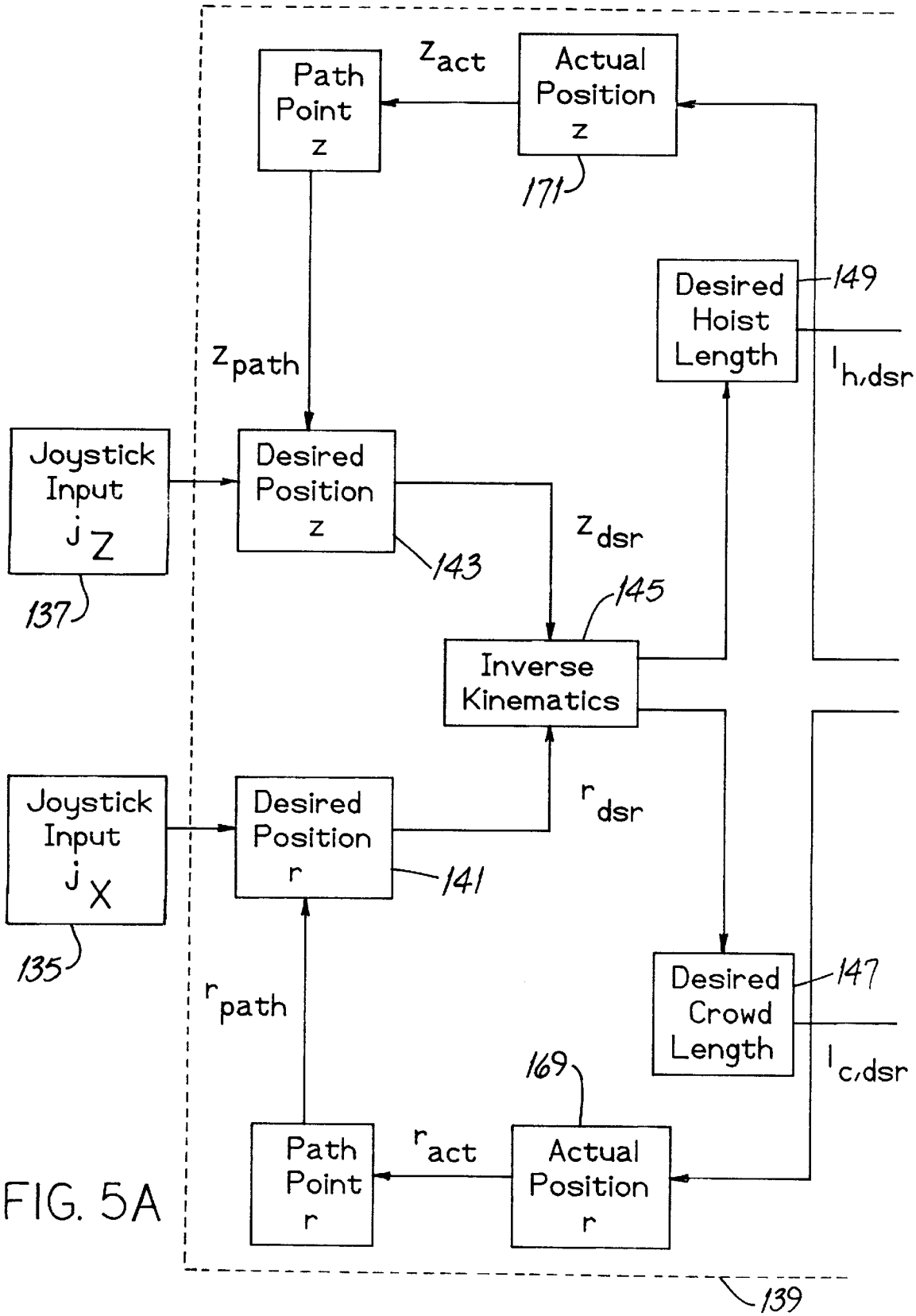
FIGS. 5A and 5B depicts a control arrangement, in flow diagram form, for the crowd and hoist functions of the shovel of FIG. 1.
Figure 5B:
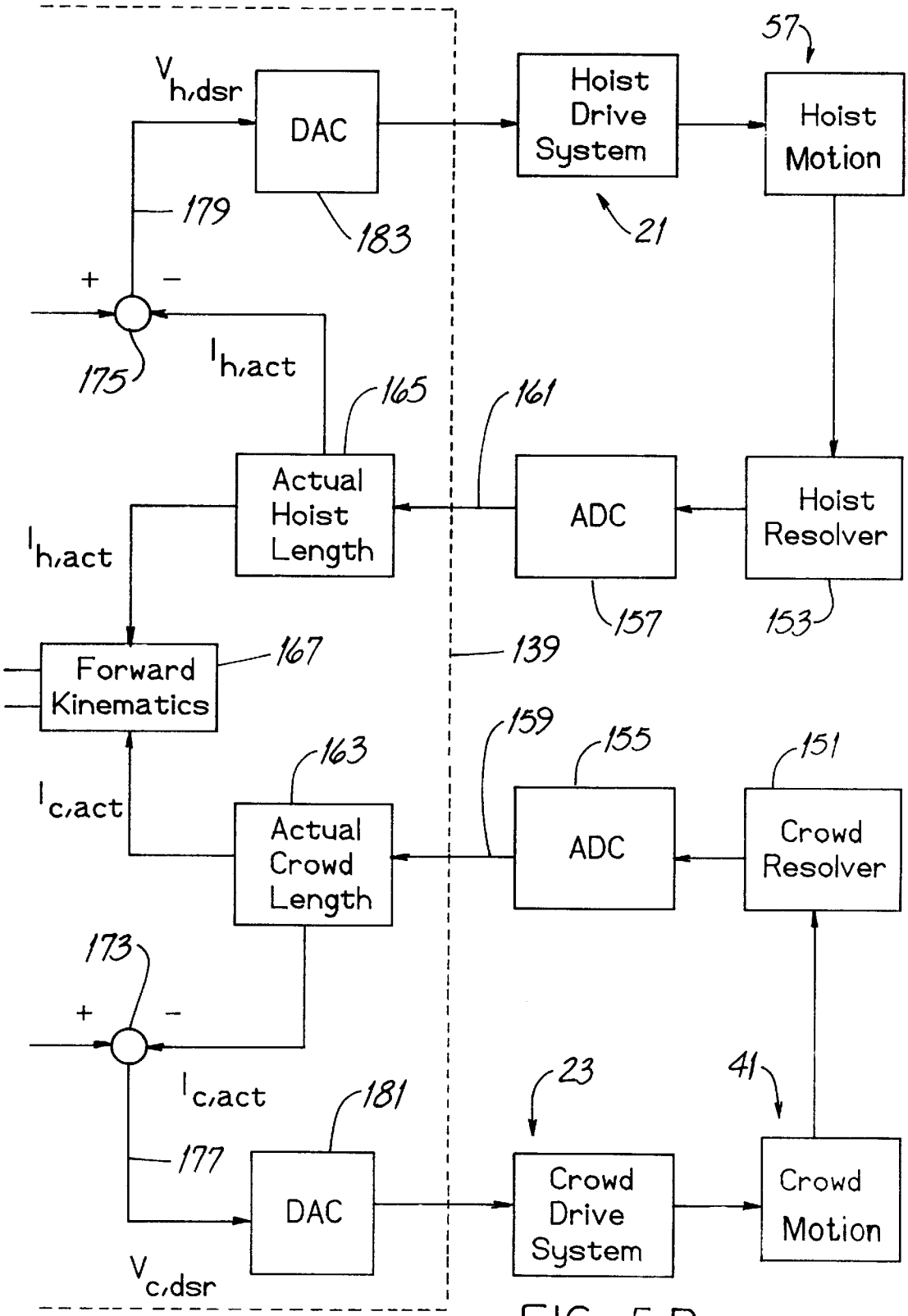

The control diagram for the hoist and crowd function will now be described. Referring to FIGS. 5A and 5B, and the following table:

| Symbol | Description |
|---|---|
| $z_{path}$ | z coordinate of the path point along the desired trajectory |
| $r_{path}$ | r coordinate of the path point along the desired trajectory |
| $z_{dsr}$ | z coordinate of the desired position to which the dipper teeth should move |
| $r_{dsr}$ | r coordinate of the desired position where the dipper teeth should move to |
| $z_{act}$ | z coordinate of the actual dipper teeth position in the RZ plane |
| $r_{act}$ | r coordinate of the actual dipper teeth position in the RZ plane |
| $l_{h,dsr}$ | desired hoist length that will position the dipper teeth at the desired position in the RZ plane |
| $l_{c,dsr}$ | desired crowd length that will position the dipper teeth at the desired position in the RZ plane |
| $l_{h,act}$ | actual hoist length read from the hoist position sensor |
| $l_{c,act}$ | actual crowd length read from the crowd position sensor |
| $V_{h,dsr}$ | desired velocity for the hoist motor |
| $V_{c,dsr}$ | desired velocity for the crowd motor |

Considering FIGS. 5A and 5B, it is to be appreciated that $j_X$ and $j_Z$, represented by the symbols 135 and 137, respectively, are the first and second output signals from the apparatus 59. Such signals $j_X$ and $j_Z$ comprise, respectively, the first and second input signals to the control arrangement 139 and are related to control of the crowd and hoist drive systems 23, 21, respectively.

The first and second input signals from the apparatus, $j_X$, $j_Z$, represent, respectively, the commanded position of the dipper teeth 37 along or parallel to the "R" axis of FIGS. 2 and 4 and along or parallel to the "Z" axis of FIG. 2. As represented by the symbols 141, 143 such signals represent the desired positions $r_{dsr}$ and $z_{dsr}$ which, respectively, are the desired position of the dipper teeth 37 along or parallel to the "R" axis and along or parallel to the "Z" axis.

Using a technique known as "Inverse Kinematics," represented by the symbol 145, these desired positions $r_{dsr}$, $z_{dsr}$ are converted to signals denoted by the symbols 147, 149 and representing the desired crowd length $l_{c,dsr}$ and the desired hoist length $l_{h,dsr}$. (That is, the transformations from "r" and "z" to $l_c$ and $l_h$ are called Inverse Kinematics.)

The crowd and hoist resolvers 151, 153, respectively, provide signals to respective analog-to-digital converters ADC 155, ADC 157. The outputs of the ADC 155, ADC 157 along the lines 159, 161, respectively, are represented by the symbols 163, 165 respectively, and constitute signals $l_{c,act}$ and $l_{h,act}$ which represent the actual crowd length and actual hoist length, respectively.

Using a technique referred to as "Forward Kinematics" (which involves changing from a Cartesian coordinate system to a cylindrical coordinate system), represented by the symbol 167, the outputs $l_{c,act}$ and $l_{h,act}$ are converted to respective signals representing the actual crowd position $r_{act}$ as represented by the symbol 169 and representing the actual hoist position $z_{act}$ as represented by the symbol 171. (Inverse Kinematics and Forward Kinematics are further discussed below.)

The signal "sets" $l_{c,dsr}$, $l_{c,act}$ and $l_{h,dsr}$, $l_{h,act}$ are directed to respective summing junctions 173, 175. Each junction 173, 175 algebraically combines two signals making up a respective set as noted above.

The results, $V_{c,dsr}$ and $V_{h,dsr}$, are directed along the respective lines 177, 179, to the digital-to-analog converters DAC 181 and DAC 183 and from thence as respective analog signals to the crowd and hoist drive systems 23, 21, respectively. Referring also to FIG. 2, such drive systems 23, 21 power the crowd motor 39 and the hoist motor 43, respectively, to cause the dipper handle 31 to move with respect to the boom 27. Crowd and hoist motion is represented by the symbols 41, 57, respectively.

The crowd position sensor, resolver 151, is coupled to the motor 39 and provides an output signal which represents the actual position of the crowd motor armature. Similarly, a hoist position sensor, the resolver 153, is coupled to the hoist motor 43 and provides an output signal which represents the actual position of the hoist motor armature. (It will be recalled that a position sensor, whether a rotary resolver or a linear sensor, provides analog voltage output signals, each value of which represents, respectively, a unique angular or linear position of the drive motor to which it is connected.)

Description of Control Diagram for Swing

Figure 13:
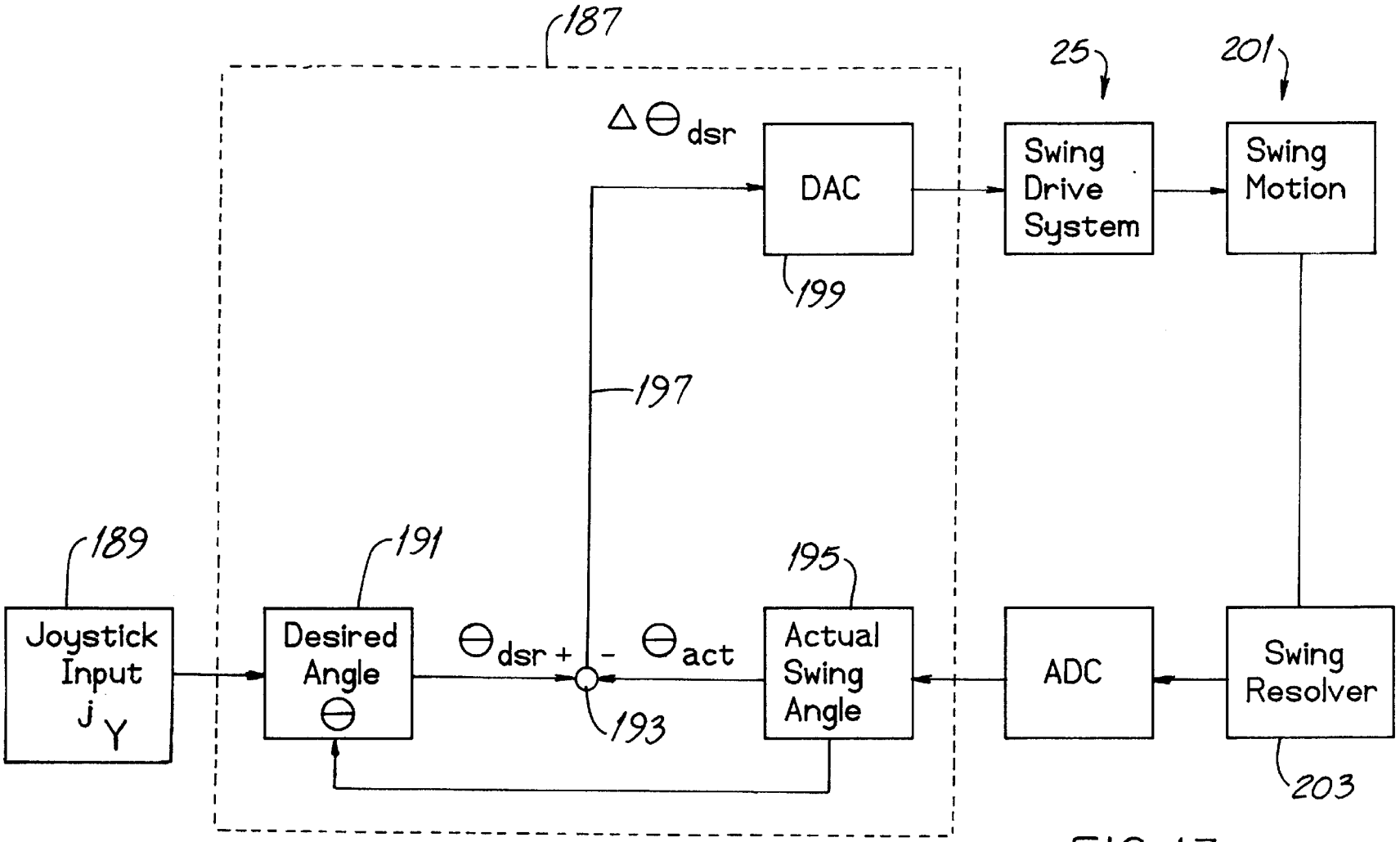
FIG. 13 depicts a control arrangement, in flow diagram form, for the swing function of the shovel of FIG. 1.

FIG. 13 shows the control arrangement 187 for the swing function. Such control arrangement 187 is more straightforward than that for the hoist and crowd functions since the swing function involves only rotational, angular movement. When the joystick knob 63 is moved along the "Y" axis, a third output signal from the apparatus, $j_Y$, is provided and is represented by the symbol 189. Such signal comprises the third input signal, a signal to the swing control arrangement 187, and represents the desired swing angle $\theta_{dsr}$ as represented by the symbol 191. Such desired swing angle $\theta_{dsr}$ is algebraically combined in a summing junction 193 with a signal representing the actual swing angle $\theta_{act}$ as represented by the symbol 195. The result, the $\Delta\theta_{dsr}$ output from the junction 193, a digital signal, is directed along the line 197 to the digital-to-analog converter DAC 199 which applies the resulting analog signal to the swing drive system 25. Referring also to FIGS. 1 and 4, the drive system 25 powers the swing motor 81 to cause the upper portion 19 to rotate with respect to the platform 11. Such swing motion is represented by the symbol 201.

A swing position sensor resolver 203, is coupled to the motor 81. The resolver 203 provides an output, i.e., a feedback signal, which represents the actual position of the swing motor armature and, thus, of the upper portion 19 with respect to the platform 11.

Kinematic Equations

Referring to FIG. 3, development of kinematic equations for an electric mining shovel 10 will now be set forth.

Geometric Aspects of Shovel Dimensions

| Label | Description | Unit of Measure |
|---|---|---|
| Lb | center-to-center length from shipper shaft 33 to boom point sheave 49 | inch |
| P | pitch radius of boom point sheave 49 | inch |

-continued

Geometric Aspects of Shovel Dimensions

| Label | Description | Unit of Measure |
|---|---|---|
| Ly | center of shipper shaft 33 to tip of dipper teeth 37, perpendicular to rack line 205 | inch |
| Lx | center of shipper shaft 33 to bail pin 53, perpendicular to rack line 205 | inch |
| $\theta_B$ | boom angle | degree |
| Rs | swing axis Z to shipper shaft 33 | inch |
| Zs | ground 13 to shipper shaft 33 | inch |

Dipper Teeth Position Related to Dipper Pin Joint Connection (Or For Dippers Not Having Bail Pins, To an Appropriate Dipper Connection Point)

To control the motion of the dipper teeth 37, kinematics equations are employed to determine the relation between configuration of the hoist cable 47 and the crowd handle 31 and the position of the dipper teeth 37. Since the invention concerns the control of the motion of the dipper teeth 37, it is preferred to formulate the kinematics equations in terms of the location of such teeth 37. However, it is to be noted that, mathematically, it is more convenient to describe the configurations of the hoist cable 47 and the crowd handle 31 in terms of the location of the dipper pin 53, as shown in FIGS. 3 and 13. Therefore, it is necessary to define a transformation equation that relates the location of the dipper teeth 37 and the location of the dipper pin 53.

It is to be noted that the boom frame of reference, $F_{boom}$ (with its origin at the axis 55 of the shipper shaft 33), has been chosen for convenience. Parameters relating to the hoist and the crowd are shown as the hoist length, $l_h$ and the crowd length, $l_c$, respectively. $R_b$ is the distance from the axis 55 of the shipper shaft 33 to the center of the dipper bail pin 53.

The following transformation equation determines the relationship between the pin joint coordinates $[r_b, z_b]$ and the teeth coordinates $[r_t, z_t]$, shown in FIG. 3;

$$\begin{bmatrix} r_b \\ z_b \end{bmatrix} = {}^bT_t \begin{bmatrix} r_t \\ z_t \end{bmatrix} \tag{2.1}$$

${}^bT_t$ denotes the transformation from the teeth coordinate system to the pin joint coordinate system. The inverse transformation can also be determined from the following equation given below.

$$\begin{bmatrix} r_t \\ z_t \end{bmatrix} = {}^tT_b \begin{bmatrix} r_b \\ z_b \end{bmatrix} \tag{2.2}$$

where ${}^tT_b$ denotes the transformation from the pin joint coordinate system to the teeth coordinate system.

Forward Kinematics Equations

To determine the location of the dipper teeth 37, for the given lengths of the hoist cable, $l_c$, and the crowd handle 31, $l_h$, a Forward Kinematics equation is applied. Since it is more convenient to describe the relation between the location of the pin 53 and the length of the hoist cable 47 and the crowd handle 31, the Forward Kinematics equation shown below is used to solve for the location of the pin joint, $[r_b, z_b]$ and the transformation described in equation (2.2) is used to obtain the location of the dipper teeth, $[r_t, z_t]$.

$$[r_b, z_b] = \text{Forward Kinematics } ([l_c, l_h]) \tag{2.3}$$

Inverse Kinematics Equation

An Inverse Kinematics equation is applied to solve for the lengths of the hoist cable, $l_h$, and the crowd handle, $l_c$, for the given set of dipper teeth coordinates, $[r_t, z_t]$. Noting equation (3.1) below, to simplify the development, the Inverse Kinematics equation is presented in terms of the location of the pin joint. The transformation equation, as described in equation (2.1) is used to obtain corresponding $[r_b, z_b]$ for given $[r_t, z_t]$.

$$[l_c, l_h] = \text{Inverse_Kinematics } ([r_b, z_b]) \tag{3.1}$$

Trajectory Generation

One of the objects of this invention is to control, intuitively, the motion of the digging dipper 35. In order to achieve the goal, the control apparatus 59 is designed in such a way that the motion of the dipper teeth 37 can be represented by the motion of the knob 63 of the control apparatus 59. In other words, a digital computer takes the signals generated from the control apparatus 59 and translates them into the desired position of the dipper teeth 37.

A history of the desired position of the dipper teeth 37 refers to the desired trajectory. The trajectory is computed by a computer at a trajectory update rate and the calculated desired positions refer to trajectory points. Since the trajectory generation is a mature technology and can be found in many robotics textbooks, a brief mathematical equation is given below:

$$P_{j+1} = P_j + V_j T \tag{4.1}$$

where $P_j$ denotes the trajectory point of the dipper teeth 37 in vector format at time instant j and equals $[r_j\ \theta_j\ z_j]^T$. $V_j$ denotes the velocity of the dipper teeth 37 in vector format and equals $[\dot{r}_j\ \dot{\theta}_j\ \dot{z}_j]^T$, and T denotes the trajectory update rate.

Regarding the matter of shoe protection, it is now to be appreciated that the control arrangements can be programmed with travel limits to prevent the dipper 35 from striking a shoe 79. For example, referring to FIGS. 4 and 10, a travel limit would be established when, as signalled by the resolvers, the dipper 35 is closely adjacent to or coincident with the boundary 207 of a zone 87.

While the principles of the invention have been shown and described in connection with but a few preferred embodiments, it is to be understood clearly that such embodiments are by way of example and are not limiting. Since the control strategies for mining shovels and draglines are closely similar, the term "dipper" in the claims is synonymous with "bucket" unless the context requires otherwise.

What is claimed:

1. A method for controlling movement of a digging dipper including:

providing an earthmoving machine having a machine upper portion with a rigid, cable-supported boom extending therefrom, a digging dipper, a first drive system having a first electric motor which moves the dipper along a generally linear first path and a second drive system having a second electric motor which moves the dipper along a second path;

providing a control apparatus having a linear reference axis and a knob mounted for movement between a first, repose position and a maximum position spaced from the repose position by a maximum displacement dimension;

displacing the knob along a substantially linear control axis to a second position, the control axis defining an angle with respect to the reference axis, the second position being spaced from the repose position by an actual displacement dimension less than the maximum displacement dimension;

energizing the drive systems; and powering the dipper along a digging axis generally parallel to the control axis;

and wherein:

the drive systems coact to power the dipper at a speed ranging from zero to a maximum dipper speed;

the powering step includes powering the dipper at a digging speed generally equal to the maximum speed multiplied by the ratio of the actual displacement dimension to the maximum displacement dimension; and the powering step includes maintaining the boom at a fixed angle relative to the upper portion.

2. The method of claim 1 wherein:

the earthmoving machine is a dragline;

the first drive system powers a hoist cable extending from the boom to the dipper;

the second drive system powers a dragging line extending between a drag winch and the dipper; and the digging axis is angled with respect to a horizontal plane and generally defines a grade contour.

3. The method of claim 1 wherein:

the powering step includes generating first and second signals representing the angular velocities of the first and second drive motors, respectively.

4. The method of claim 1 wherein the dipper has digging teeth, each having a tooth point, the second position is a command position, the displacing step is followed by a computing step and wherein:

the computing step includes determining, in a cylindrical coordinate system, "r" and "z" coordinates representing the commanded location of the tooth points.

5. The method of claim 4 wherein:

the first drive system drives a handle connected to the dipper for dipper crowd;

the second drive system drives a cable connected to the dipper for dipper hoist;

and wherein:

the determining step includes computing commanded velocity signals for dipper crowd and dipper hoist.

6. The method of claim 5 wherein computing the commanded velocity signals is followed by the step of applying the velocity signals to first and second adjustable speed drives connected to the first and second motors, respectively.

7. The method of claim 1 wherein:

the cable supporting the boom is a boom cable;

the machine is a mining shovel having a hoist cable extending between the dipper and the second drive motor, the hoist cable having a length measured between two reference points;

the mining shovel also has a dipper handle connected to the dipper and moved with respect to the boom by the second drive motor, the dipper handle having a length measured between another two reference points;

and wherein the powering step is followed by:

determining the lengths.

8. The method of claim 7 wherein the dipper has digging teeth, each having a tooth point, the second position is a command position, the step of determining the lengths is followed by a computing step and wherein:

the computing step includes determining, in a cylindrical coordinate system, "r" and "z" coordinates representing the actual location of the tooth points.

9. The method of claim 8 including generating an error signal to minimize the difference between the commanded location of the tooth points and the actual location thereof.

10. The method of claim 7 wherein the step of determining the lengths includes detecting signals provided by separate position sensors connected to the first and second electric motors, respectively.

11. The method of claim 1 wherein:

the control apparatus has a housing fixed with respect to the upper portion; and the displacing step includes moving the knob with respect to the housing.

12. The method of claim 11 wherein:

the machine has a platform supporting the upper portion which is rotatable about a rotation axis; and the control axis is coincident with a generally vertical plane which includes the rotation axis.

13. The method of claim 1 wherein:

the control apparatus has a housing fixed with respect to the upper portion;

the machine has a platform which supports the upper portion and which rotates about a rotation axis; and the displacing step includes moving the knob laterally, thereby rotating the upper portion about the rotation axis.

14. The method of claim 13 wherein the platform has shoes forming a crawler track for transporting the machine and the rotating step is followed by the step of stopping rotation of the upper portion when the dipper is at a predetermined distance from the shoes.

15. The method of claim 1 wherein:

the machine is a mining shovel having a platform mounted on crawler tracks extending parallel to a machine axis;

the machine includes an upper portion rotatably supported on the platform and having a boom extending therefrom along a boom axis;

the upper portion is rotated so that the boom axis is angular to the machine axis;

the control apparatus has a housing fixed with respect to the machine;

and wherein:

the displacing step includes moving the knob toward the housing;

the powering step includes moving the dipper toward one of the crawler tracks;

and the method includes the step of:

stopping movement of the dipper as the dipper approaches one of the tracks.

16. In combination, an earthmoving machine having a boom supported by a cable and an apparatus for controlling movement of a dipper on the machine and wherein:

the machine includes a first electrical drive system for moving the dipper alone a generally linear first path, a second electrical drive system for moving the dipper along an arcuate second path and a third electrical drive system for moving the dipper along a third path in a swing direction;

the first electrical drive system includes a first adjustable speed drive coupled to a first motor for moving the dipper along the first path;

the second electrical drive system includes a second adjustable speed drive coupled to a second motor for moving the dipper along the second path;

the third electrical drive system includes a third adjustable speed drive coupled to a third motor for moving the dipper along the third path;

and wherein the apparatus includes:

a single control knob having a repose position;

first, second and third motion transducers mechanically coupled to the knob;

and wherein, in a Cartesian coordinate system having an origin and "X," "Z" and "Y" axes perpendicular to one another,:

the repose position is at the origin;

the first motion transducer provides a first output signal when the knob is displaced from the repose position along the "X" axis;

the second motion transducer provides a second output signal when the knob is deflected from the repose position in a "Z" axis direction;

the third motion transducer provides a third output signal when the knob is deflected from the repose position in a "Y" axis direction;

and wherein:

when the first, second and third motion transducers provide, respectively, the first, second and third output signals, first, second and third command voltages representing the first, second and third output signals are applied to the first, second and third adjustable speed drives, respectively.

17. The combination of claim 17 wherein:

the machine is a dragline;

the dipper is suspended by another cable separate from the cable supporting the boom; and the first path is generally vertical.

18. The combination of claim 16 wherein:

the machine is a mining shovel;

the dipper is supported by another cable separate from the cable supporting the boom; and the first path is generally horizontal.

* * * * *